US011577764B2

(12) United States Patent
Liebig

(10) Patent No.: US 11,577,764 B2
(45) Date of Patent: Feb. 14, 2023

(54) VEHICLE-BASED DEVICE FOR RECEIVING INFORMATION FROM A TRACK-BASED TRANSMISSION DEVICE

(71) Applicant: SIEMENS MOBILITY GMBH, Munich (DE)

(72) Inventor: Andreas Liebig, Wolfenbuettel (DE)

(73) Assignee: Siemens Mobility GmbH, Munich (DE)

( * ) Notice: Subject to any disclaimer, the term of this patent is extended or adjusted under 35 U.S.C. 154(b) by 367 days.

(21) Appl. No.: 16/761,892

(22) PCT Filed: Oct. 8, 2018

(86) PCT No.: PCT/EP2018/077252
§ 371 (c)(1),
(2) Date: May 6, 2020

(87) PCT Pub. No.: WO2019/086206
PCT Pub. Date: May 9, 2019

(65) Prior Publication Data

US 2021/0171074 A1 Jun. 10, 2021

(30) Foreign Application Priority Data

Nov. 6, 2017 (DE) ..... 102017219644.0

(51) Int. Cl.
*B61L 23/00* (2006.01)
*H04L 27/00* (2006.01)
(Continued)

(52) U.S. Cl.
CPC ..... *B61L 3/121* (2013.01); *B61L 3/24* (2013.01); *B61L 27/20* (2022.01); *B61L 27/57* (2022.01);
(Continued)

(58) Field of Classification Search
None
See application file for complete search history.

(56) References Cited

FOREIGN PATENT DOCUMENTS

CN 101293527 A 10/2008
CN 105292187 A 2/2016
(Continued)

OTHER PUBLICATIONS

FFFIS for Eurobalise REF : Subset—036 Issue : 3.0.0 Date : Feb. 24, 2012.

(Continued)

*Primary Examiner* — Adam D Tissot
(74) *Attorney, Agent, or Firm* — Laurence A. Greenberg; Werner H. Stemer; Ralph E. Locher

(57) ABSTRACT

A vehicle-based device for a vehicle, in particular a rail vehicle, includes a receiving device which, when passing a track-based transmission device, is configured for receiving a signal, which is at least also frequency-modulated, from the track-based transmission device. The vehicle-based device includes an evaluation device which is configured for generating a crosstalk warning, namely in accordance with signal levels at different frequencies of the received frequency-modulated transmission signal and/or in accordance with the frequency curve. A vehicle, in particular a rail vehicle, and a method for transmitting at least one piece of information from a track-based transmission device to a passing vehicle, in particular a rail vehicle, are also provided.

14 Claims, 8 Drawing Sheets

(51) Int. Cl.

| | |
|---|---|
| ***B61L 3/12*** | (2006.01) |
| ***B61L 3/24*** | (2006.01) |
| ***B61L 27/20*** | (2022.01) |
| ***B61L 27/57*** | (2022.01) |
| ***B61L 27/70*** | (2022.01) |

(52) U.S. Cl.
CPC ..... *B61L 27/70* (2022.01); *B61L 2003/123* (2013.01); *B61L 2027/202* (2022.01)

(56) References Cited

FOREIGN PATENT DOCUMENTS

| | | | | |
|---|---|---|---|---|
| DE | 102013220868 | A1 | 4/2015 | |
| DE | 102016215696 | A1 | 2/2018 | |
| EP | 2022697 | A1 | 2/2009 | |
| EP | 2676860 | A1 | 12/2013 | |
| FR | 2873341 | A1 | 1/2006 | |
| FR | 2873341 | B1 * | 8/2014 | ..... B61L 3/121 |
| JP | 3444518 | B2 | 9/2003 | |
| WO | WO-9411754 | A1 * | 5/1994 | ..... G01S 13/755 |
| WO | WO 9411754 | A1 | 5/1994 | |
| WO | WO 2015055391 | A2 | 4/2015 | |
| WO | WO 2018036736 | A1 | 3/2018 | |
| WO | WO 2018046217 | A1 | 3/2018 | |

OTHER PUBLICATIONS

Ho, Keang-Po et al.: "Methods for Crosstalk Measurement and Reduction in Dense WDM Systems", Journal of Lightwave Technology vol. 14, No. 6, Jun. 1996 pp. 1127-1135.

Hushley, Jeff et al.: "Crosstalk Measurement Techniques for Multi-Channel and Multi-Rate High Speed Serial Communication Systems", Jul. 2007, [retrieved from internet on Aug. 17, 2021], <URL: https://www.cypress.com/file/88681/download>.

Cardillo, E. et al.: "A novel approach for crosstalk minimisation in frequency modulated continuous wave radars"; Electronics Letters; Sep. 28, 2017, vol. 53, No. 20, pp. 1379-1381.

* cited by examiner

VEHICLE-BASED DEVICE FOR RECEIVING INFORMATION FROM A TRACK-BASED TRANSMISSION DEVICE

BACKGROUND OF THE INVENTION

Field of the Invention

The invention relates to a vehicle-based device for a vehicle, in particular a rail vehicle, said device comprising a receiving device which, when passing a track-based transmission device, is suitable for receiving a transmission signal, which is at least also frequency-modulated, from said track-based transmission device.

As is known, in railway installations transponder devices are used to transmit information from the track to the vehicle. The information to be transmitted can, for example, identify the respective transponder, specify its location, or describe signal states and/or properties of the track being passed over.

For example, the so-called Eurobalise is known for locating rail vehicles. The Eurobalise is a passive balise which, upon the approach of a rail vehicle, is put into operation by means of energy transmitted electromagnetically at 27 MHz and transmits a position signal frequency-modulated at frequencies of 3.95 MHz or 4.52 MHz, enabling the positioning of a passing rail vehicle. The position signal contains coding which identifies the balise so that the vehicle, which knows the positions of balises laid in the route network, can determine its own position.

Document WO 94 11754 A1 makes provision for data transmission between two interrogation and response stations which usually have a high relative speed, at least the response station having a delay line with reflection points, preferably a surface wave component. The component has a substrate suitable for conducting surface waves on which an interdigital converter and at least one reflector are located. Here, interrogation pulses are transmitted from the interrogation station to the response station. The modulation of these interrogation pulses in the interrogation station and the corresponding response pulses in the response station leads to the transmission of identification signals between the interrogation and response stations.

Document EP 2 676 860 A1 describes a system and a method for modulating a telepowering signal in a downlink communication. A fingerprint module generates a fingerprint signal that can be modulated with a telepowering signal for communication by a transmission module in a downlink communication. The fingerprint signal is reflected by a track-based equipment module and received by the transmission module.

In document WO 2015 055391 A2, a Eurobalise vehicle apparatus is used, having two reception frame antennae with identical reception properties and the same spatial orientation. An evaluation apparatus is connected to the reception frame antennae, which register a receive signal while a train is passing a transmitter. This receive signal does not come from the Eurobalise if the reception level difference of the reception frame antennae is below a threshold value, wherein a reference signal corresponds to a specific receive signal while passing the transmitter.

SUMMARY OF THE INVENTION

The object underlying the invention is to specify a vehicle-based device which can detect crosstalk of a transmission signal from a track-based transmission device, wherein it should be possible to generate a crosstalk warning in a particularly simple but nevertheless reliable manner.

This object is achieved according to the invention by a vehicle-based device for a vehicle, in particular a rail vehicle, said device comprising a receiving device which, when passing a track-based transmission device, is configured for receiving a signal, which is at least also frequency-modulated, from said track-based transmission device. Advantageous embodiments of the device according to the invention are specified in subclaims.

According to the invention, it is provided that the vehicle-based device has an evaluation device which is suitable for generating a crosstalk warning, namely depending on the signal levels at different frequencies of the frequency-modulated transmission signal received and/or the frequency curve.

A major advantage of the device according to the invention can be seen in that it can reliably generate a crosstalk warning if there is a certain probability of crosstalk of a transmission signal from an "inaccurate" track-based transmission device—that is to say, from a device whose transmission signal cannot be evaluated. Namely, the inventor determined that in terms of frequency a crosstalk warning can be generated particularly easily, but nevertheless very reliably; accordingly, it is provided according to the invention that the crosstalk warning is generated as a function of signal levels of different frequencies or as a function of the frequency curve.

The track-based transmission device is preferably a transponder device or a component of a transponder device. In this case, it is advantageous if the vehicle-based device has a vehicle-based transmission device which is suitable for transmitting an activation signal for activating the transponder device. In this case, the evaluation device can detect crosstalk of a frequency-modulated transmission signal or response signal from track-based transponder devices which have not been activated by their own vehicle but by another vehicle.

It is advantageous if the evaluation device evaluates the frequency curve and/or the signal levels at different frequencies of the received transmission signal and generates the crosstalk warning if the frequency curve and/or the signal levels indicate a response signal from a transponder device which has been activated by a transmission device other than that of their own vehicle-based device, whether it be a transmission device of another vehicle-based device of their own vehicle or another transmission device of another vehicle.

The evaluation device is preferably designed such that it compares the signal level at a signal frequency of the frequency-modulated transmission signal with the signal level at another signal frequency of the frequency-modulated transmission signal and generates the crosstalk warning if the signal level deviates beyond a predefined degree.

The frequency-modulated transmission signal is preferably a binary signal having a first signal frequency at a logical "0" and a second signal frequency at a logical "1". It is also advantageous if the signal amplitudes at the two signal frequencies are the same size or at least approximately (±10%) the same size.

It is particularly advantageous if the evaluation device is designed such that it compares the signal level at a signal frequency, in particular the aforementioned first signal frequency, with the signal level at another signal frequency, in particular the aforementioned second signal frequency, and generates the crosstalk warning if the signal level difference reaches or exceeds a predefined threshold or is outside a predefined set point differential range.

Alternatively or additionally, but just as advantageously, it can be provided that the evaluation device is designed such that it generates the crosstalk warning if the edge steepness of the frequency curve falls below a predefined degree over time during signal frequency changes.

In the latter variant, the evaluation device is preferably designed such that it measures the edge steepness of the signal frequency during signal frequency changes and generates the crosstalk warning if the amount of edge steepness reaches or falls below a predefined threshold.

The vehicle-based device is preferably suitable for activating balises of the ETCS standard (European Train Control System) and processing response signals from balises of the ETCS standard.

Furthermore, the invention relates to a vehicle, in particular a rail vehicle. According to the invention, it is provided that this vehicle is equipped with a vehicle-based device, as described above.

Furthermore, the invention relates to a method for transmitting at least one item of information from a track-based transmission device to a passing vehicle, wherein, in the method, the track-based transmission device transmits a track-based transmission signal which is at least also frequency-modulated.

According to the invention, it is provided that there is vehicle-based evaluation of the signal levels at different frequencies of the received transmission signal and/or of the frequency curve of the received transmission signal and a crosstalk warning (UW) is or is not generated depending on the frequency curve and/or signal levels.

With regard to the advantages of the method according to the invention, reference is made to the above statements in connection with the vehicle-based device according to the invention.

The frequency-modulated transmission signal is preferably a binary signal having a first signal frequency at a logical "0" and a second signal frequency at a logical "1".

It is advantageous if the signal level at the first signal frequency is compared with the signal level at the second signal frequency and the crosstalk warning is generated if the signal level difference reaches or exceeds a predefined threshold.

Alternatively or additionally, it is considered advantageous if the edge steepness of the signal frequency is detected during signal frequency changes from the first signal frequency to the second signal frequency and/or from the second signal frequency to the first signal frequency and the crosstalk warning is generated if the edge steepness falls below a predefined degree.

In a particularly preferred embodiment, it is provided that the signal level at the first signal frequency, the signal level at the second signal frequency and the edge steepness of the signal frequency during signal frequency changes from the first signal frequency to the second signal frequency and from the second signal frequency to the first signal frequency is detected and the crosstalk warning is generated if the signal level at the first signal frequency deviates from the signal level at the second signal frequency beyond a predefined degree or the edge steepness of the signal frequency falls below a predefined degree during signal frequency changes.

The track-based transmission device is preferably a track-based transponder device or a component of a track-based transponder device, in particular a track-based balise. In this case, it is advantageous if a vehicle-based transmission device transmits an activation signal to activate the track-based transponder device and, after receiving the activation signal, the track-based transponder device transmits a response signal, which is at least also frequency-modulated, as the track-based transmission signal.

The invention is explained in more detail hereinafter with reference to exemplary embodiments.

BRIEF DESCRIPTION OF THE SEVERAL VIEWS OF THE DRAWING

FIG. 5 shows a further exemplary embodiment of an evaluation device which can be used in the vehicle-based devices of the rail vehicles in accordance with FIG. 1, FIG. 6-7 show, by way of example, frequency curves over time of a response signal which can be transmitted by a track-based transponder device of the track system in accordance with FIG. 1, wherein

DETAILED DESCRIPTION OF THE INVENTION

Figure 1:
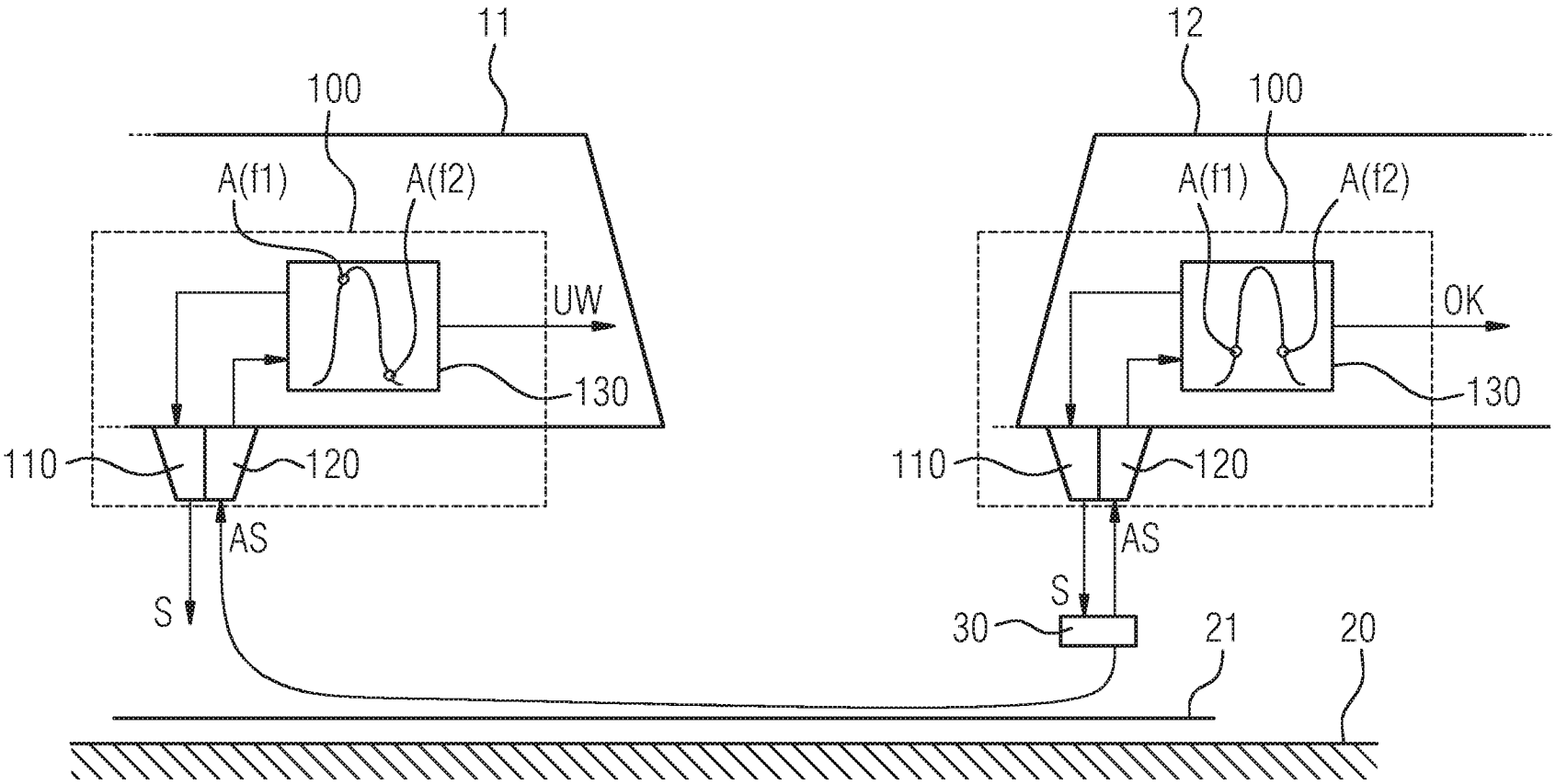
FIG. 1 shows two rail vehicles located on a track system, each equipped with an exemplary embodiment of a vehicle-based device according to the invention.

For the sake of clarity, the same reference characters are always used for identical or comparable components in the figures.

FIG. 1 shows a schematic view from the side of two rail vehicles traveling on a track system 20. The rail vehicle on the left in FIG. 1 is identified by the reference character 11 and the rail vehicle on the right in FIG. 1 is identified by the reference character 12.

The two rail vehicles 11 and 12 are each equipped with a vehicle-based device 100 comprising a transmission device 110, a receiving device 120 and an evaluation device 130. Hereinafter, it is assumed by way of example that the two vehicle-based devices 100 of the two rail vehicles 11 and 12 are structurally identical or at least both can operate according to the methods described below by way of example.

The vehicle-based devices 100 of the two rail vehicles 11 and 12 are each designed in such a way that their transmission devices 110 transmit or are at least capable of transmitting an activation signal S for activating track-based transponder devices permanently or at least while traveling over the track system 20. For reasons of clarity, in the illustration in accordance with FIG. 1 only a single track-based transponder device is shown and identified by the reference character 30. In the track system 20, a plurality of comparable track-based transponder devices 30 are usually provided.

Hereinafter, it is assumed by way of example that the track-based transponder device 30 is a transponder device which, if an activation signal S is received, transmits a frequency-modulated or at least also frequency-modulated response signal AS. The response signal AS is preferably a binary signal which has a first signal frequency f1 of, for example, between 3.9 MHz and 4.0 MHz (for example, 3.95 MHz) at a logical "0" and a second signal frequency f2 of, for example, between 4.5 MHz and 4.6 MHz (for example, 4.52 MHz) at a logical "1". The amplitudes at the first signal frequency f1 and the second signal frequency f2 are preferably the same size or preferably only differ within a range of at most ±10%.

The track-based transponder device 30 can be, for example, a balise which operates according to the ETCS (European Train Control System) standard and is accordingly able to output a response signal AS according to the ETCS standard after activation by an activation signal S.

In the illustration in accordance with FIG. 1, it is assumed by way of example that the rail vehicle 12 on the right in FIG. 1 is just passing over the track-based transponder device 30 with its transmission device 110 and its receiving device 120. Accordingly, the activation signal S of the transmission device 110 will reach and activate the track-based transponder device 30 so that the track-based transponder device 30 can send a response signal AS back to the receiving device 120 of the rail vehicle 12.

In the illustration in accordance with FIG. 1, in the region between the two rail vehicles 11 and 12 in the track system 20 a track-based conductor 21 is installed, which, for example, may form a component of a linear train influencing device (LZB) or is a component of a cable or the like. The conductor 21 leads to the response signal AS emitted by the track-based transponder device 30 not only reaching the receiving device 120 of the rail vehicle 12 but also being able to electromagnetically couple into the conductor 21 and—passed through the conductor 21—being able to reach the receiving device 120 of the rail vehicle 11. In other words, the receiving device 120 of the rail vehicle 11 will also receive a response signal AS from the track-based transponder device 30 although the rail vehicle 11 is not currently traveling over this transponder device 30.

The evaluation devices 130 of the vehicle-based devices 100 of the two rail vehicles 11 and 12 are preferably designed in such a way that they can detect crosstalk of a response signal AS from a transponder device 30 over which the respective rail vehicle is not currently traveling as reliably as possible. The evaluation devices 130 are preferably suitable for detecting crosstalk based on the signal levels of the response signal AS at different frequencies of the received response signal and/or the frequency curve of the received response signal AS. This will be explained in more detail hereinafter by way of example in connection with FIGS. 2 to 8.

Figure 2:
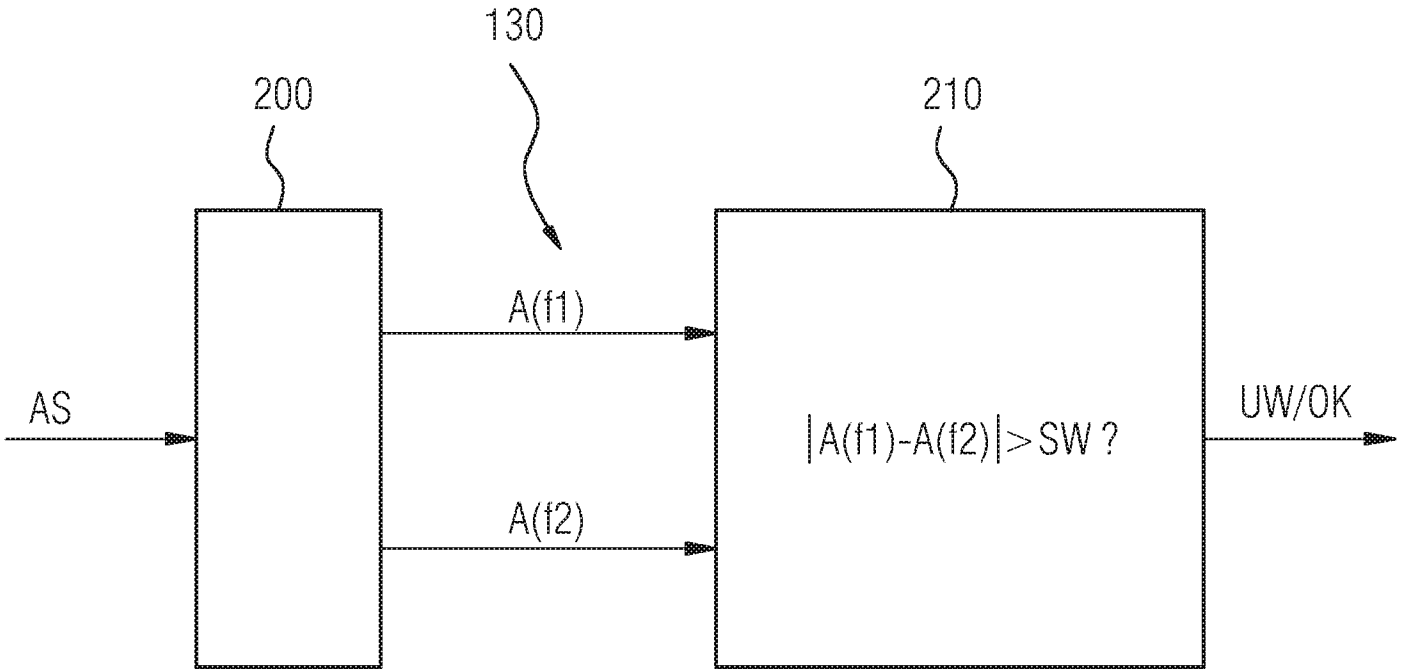
FIG. 2 shows an exemplary embodiment of an evaluation device for the vehicle-based devices in the rail vehicles in accordance with FIG. 1, FIG. 3-4 show, by way of example, the influence of a series resonance caused by the track system on the response signal of a track-based transponder device located in the track system.

FIG. 2 shows an exemplary embodiment of an evaluation device 130 which can be used in the rail vehicles 11 and 12 in accordance with FIG. 1 or their vehicle-based devices 100.

The evaluation device 130 in accordance with FIG. 2 has an amplitude measuring device 200 on the input side which operates in a frequency-related manner and can thus also be referred to as a frequency-related amplitude measuring device.

The amplitude measuring device 200 can, for example, operate numerically and have a sampling unit on the input side which samples the response signal AS. The sample values can be subjected to a Fourier transform by means of which the sample values are transformed into the frequency range. The amplitude measuring device 200 can then determine the amplitude of the response signal AS at the first signal frequency f1 of the binary response signal AS and the second signal frequency f2 of the binary response signal AS.

In the case of an undisturbed response signal AS, the amplitudes A(f1) and A(f2) at the two signal frequencies f1 and f2 will be the same size or at least approximately the same size, whereas in the case of a disturbance or resonance, in particular a series resonance through a conductor 21, as shown in FIG. 1, an amplitude difference will occur.

Arranged downstream of the amplitude measuring device 200 in the evaluation device 130 in accordance with FIG. 2 is a comparison device 210 which compares the signal levels or amplitudes A(f1) and A(f2) with one another at the two signal frequencies f1 and f2 and outputs a crosstalk warning UW if the deviation reaches or exceeds a predefined threshold.

For example, the comparison device 210 can subtract the two signal levels or amplitudes from one another, forming a signal level difference, and compare the signal level difference:

$$|A(f1)-A(f2)|>SW?$$

and generate the crosstalk warning UW if a predefined threshold SW is reached or exceeded.

If the comparison device 210 determines that the signal level difference does not reach or exceed the predefined threshold SW, then it can either generate no signal at all on the output side or instead, an output signal OK, which indicates that no crosstalk warning is to be generated.

Figure 3:
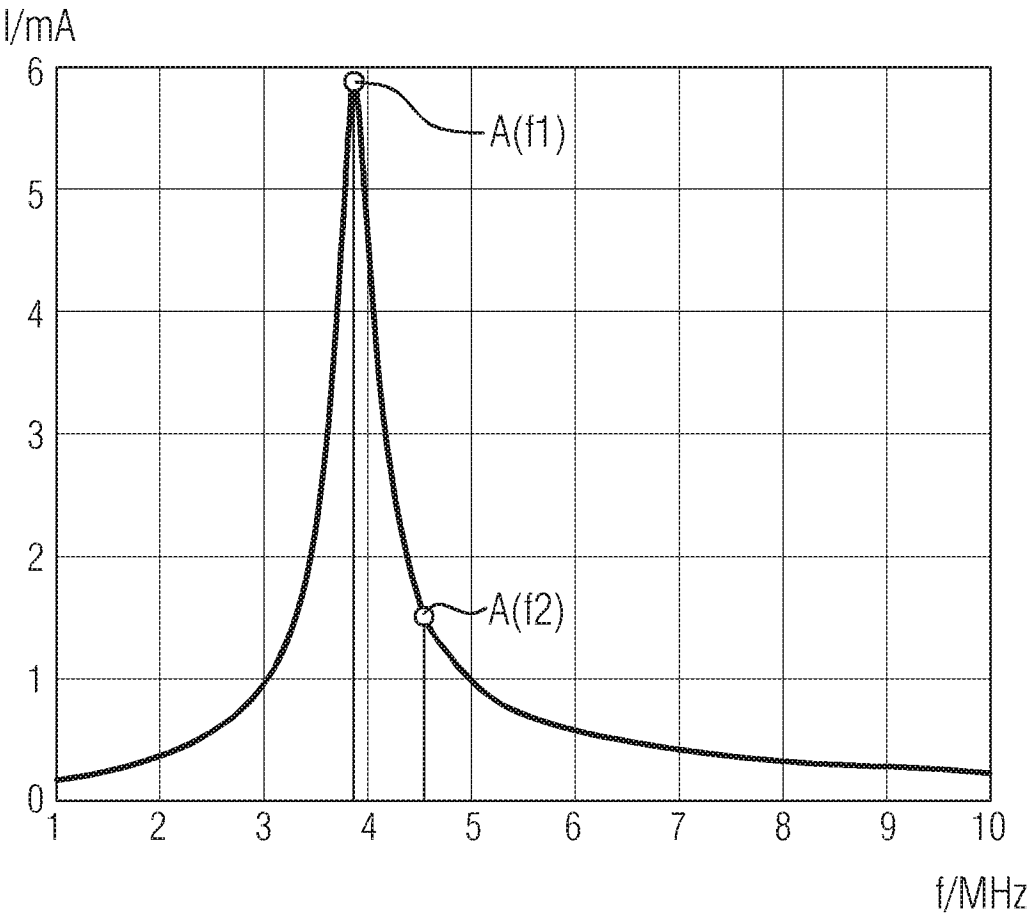

FIG. 3 shows the signal levels or amplitudes of the response signal AS—in the form of a current I over the frequency f—at the two signal frequencies f1 and f2, for example, if the conductor 21 in the track system 20 in accordance with FIG. 1, alone or with other components, forms a series resonance circuit whose resonance frequency just corresponds to the first signal frequency f1. It can be seen that a level increase occurs for the first signal frequency f1 as a result of the series resonance, whereas in the case of the second signal frequency f2, this increase does not occur.

As a result of the difference formation provided in the embodiment variant in accordance with FIG. 2, the comparison device 210 and thus the evaluation device 130 can determine overall that signal distortion by crossover has occurred, for example, as a result of resonance through the conductor 21 in accordance with FIG. 1, and accordingly generate the above-mentioned cross talk warning UW.

Figure 4:
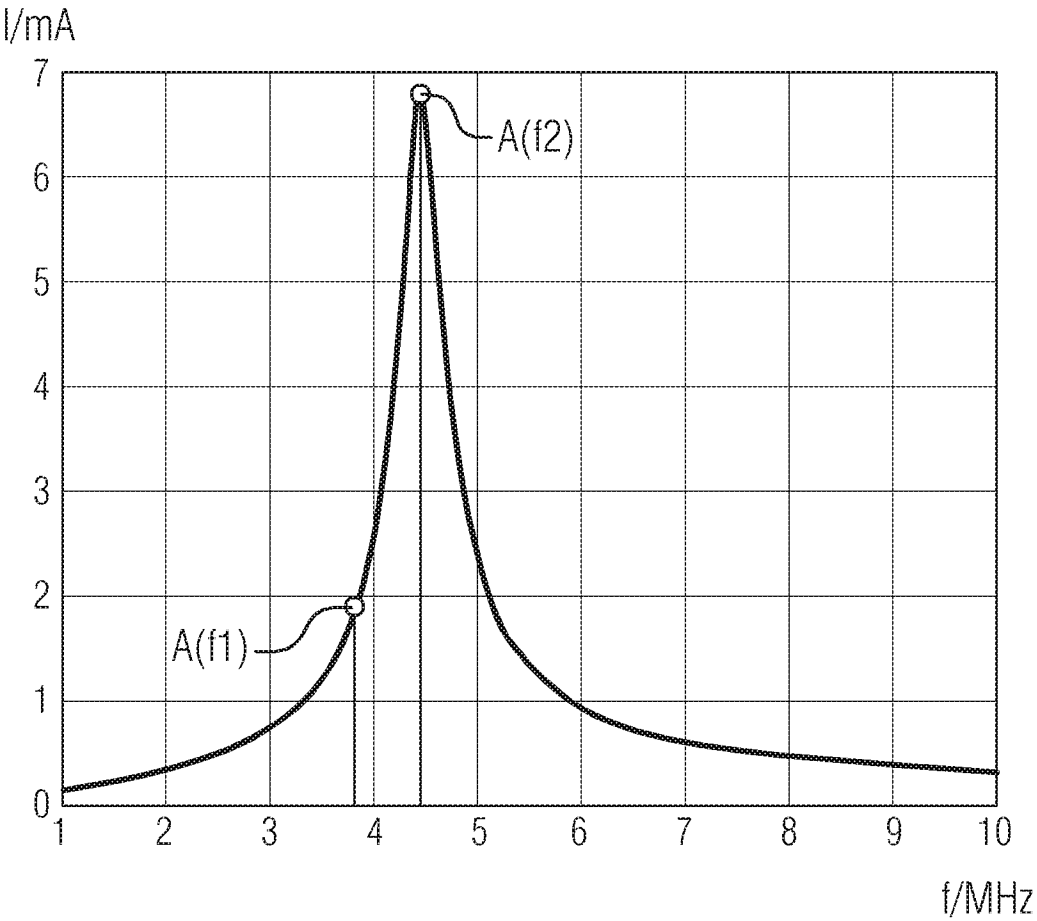

FIG. 4 shows the distortion of the signal levels of the response signal AS by way of example if the series resonance frequency of a series resonance circuit formed by the conductor 21 in accordance with FIG. 1, or at least formed therewith, corresponds precisely to the second signal frequency f2. In this case too, the signal levels of the response signal AS at the two signal frequencies f1 and f2 will differ significantly, enabling the rail vehicle 11 in accordance with FIG. 1 to generate the crosstalk warning UW.

Figure 5:
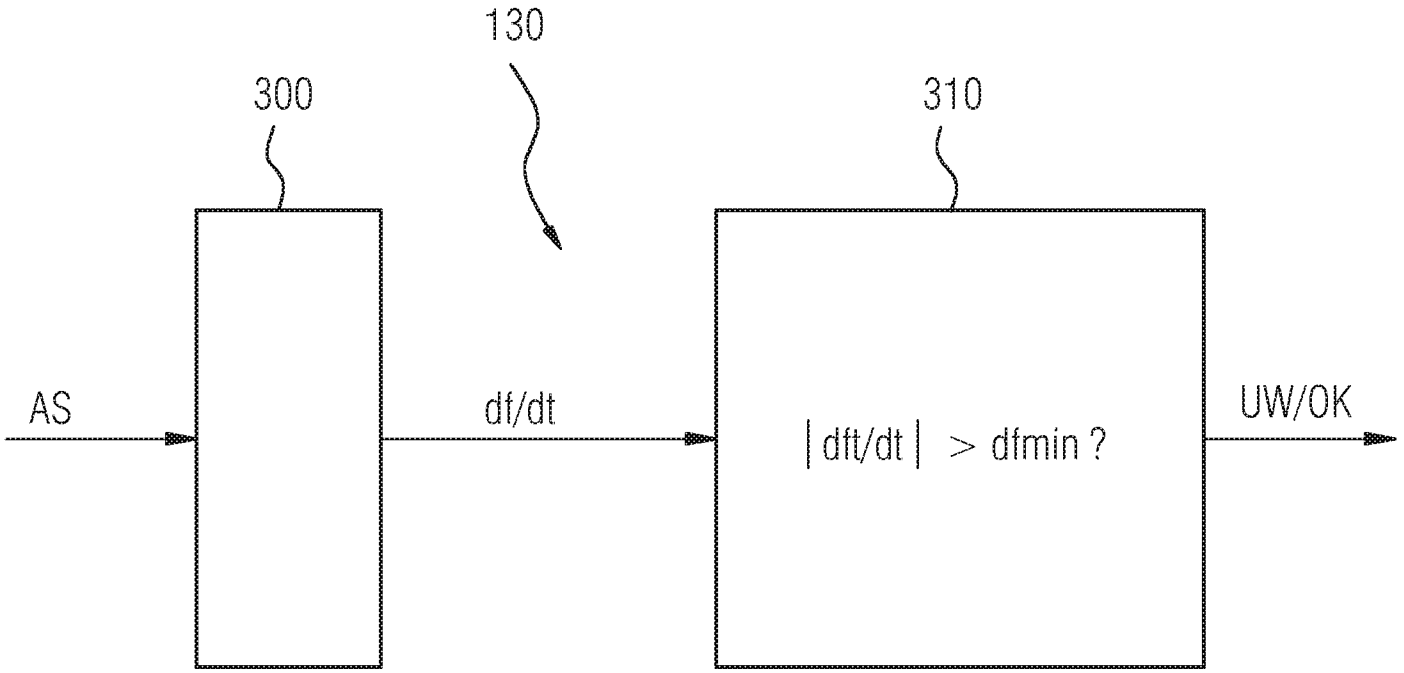

FIG. 5 shows an exemplary embodiment of an evaluation device 130 which can be used instead of, or in addition to, the evaluation device 130 shown in connection with FIG. 2. The evaluation device 130 in accordance with FIG. 5 has a frequency curve measuring device 300 on the input side, downstream of which a comparison device 310 is arranged.

Figure 6:
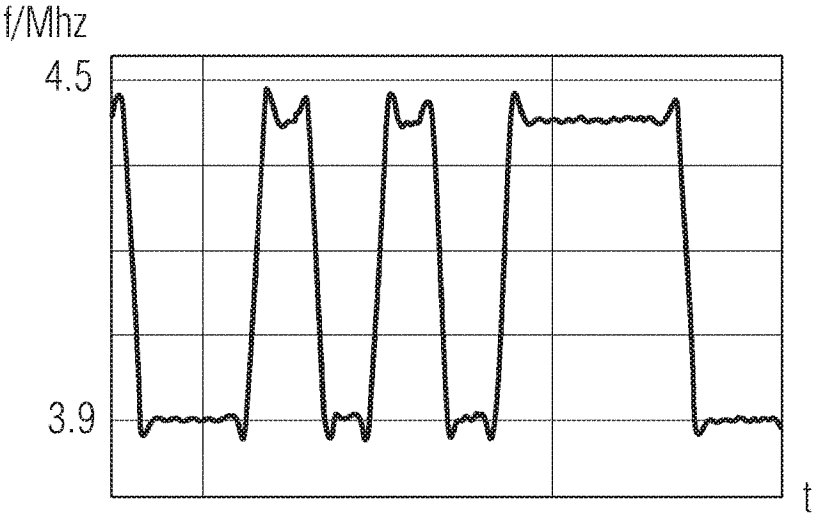
FIG. 6 shows the ideal scenario without the influence of the track system or without series resonance by the track system and FIG. 7 shows, by way of example, the frequency curve in the event of influence by series resonance.

The frequency curve measuring device 300 can, for example, operate numerically and have a sampling unit on the input side which samples the response signal AS. The sample values can be subjected to a Fourier transform which transforms the sample values into the frequency range. After such a Fourier transform, the frequency curve f can be determined over time t, as shown by way of example in FIGS. 6 and 7. FIG. 6 shows the frequency curve in the event that no signal distortion by the track system 20 or a conductor 21 located therein (cf. FIG. 1) has occurred. It can be seen that the frequency changes between the first signal frequency f1 and the second signal frequency f2 are relatively fast and the signal edges during the frequency changes are steep.

Figure 7:
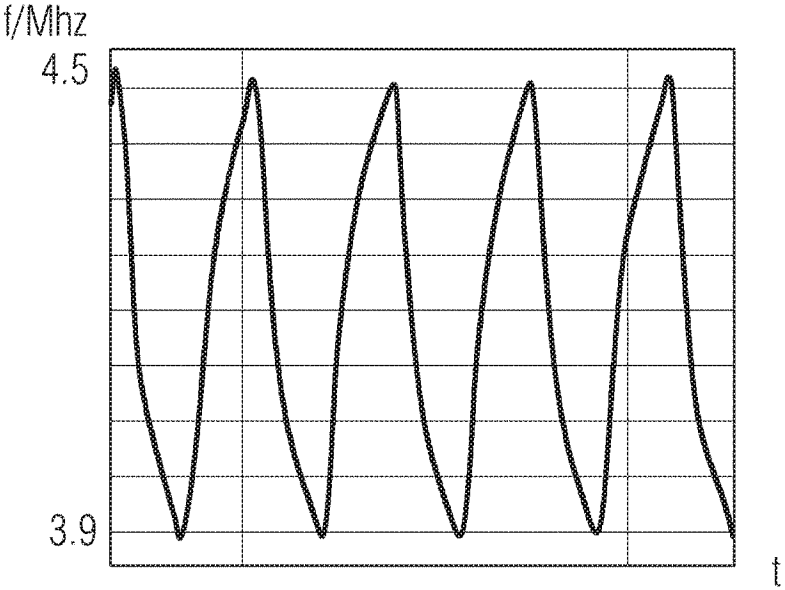

In comparison, FIG. 7 shows the frequency curve f over time t in the event that the edge steepness during the signal changes between the first signal frequency f1 and the second signal frequency f2 is drastically reduced, compared to the ideal curve in accordance with FIG. 6, by a resonance, in particular a series resonance which may be caused, for example, by the conductor 21 of the track system 20 in accordance with FIG. 1.

After the Fourier transform of the response signal AS into the frequency range, the frequency curve measuring device 300 will measure the edge steepness during signal frequency changes and output corresponding edge steepness values df/dt.

The edge steepness values df/dt reach the comparison device 310 which compares said values to a predefined edge steepness threshold dfmin and outputs a crosstalk warning UW on the output side if the edge steepness values df/dt do not reach or do not exceed the edge steepness threshold dfmin in the event of edges or signal frequency changes.

If the edge steepness threshold dfmin is exceeded or reached, the comparison device 310 will either not output any warning or any signal or instead output an output signal OK, which indicates that a crosstalk warning is not to be output.

Figure 8:
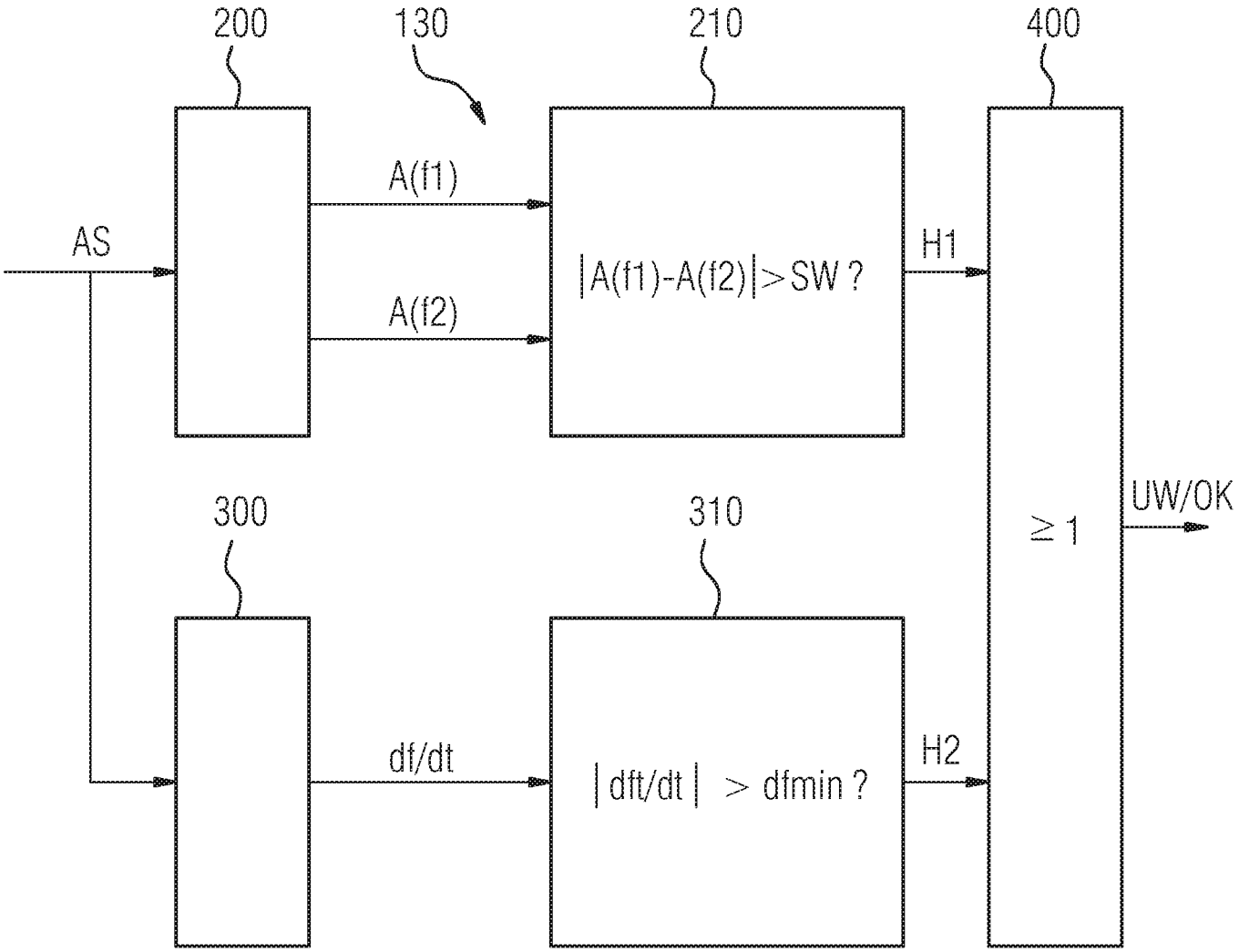
FIG. 8 shows a further exemplary embodiment of an evaluation device which can be used in the vehicle-based devices of the rail vehicles in accordance with FIG. 1.

FIG. 8 shows a further exemplary embodiment of an evaluation device 130 which can be used in the vehicle-based devices 100 of the rail vehicles 11 and 12 in accordance with FIG. 1. The evaluation device 130 in accordance with FIG. 8 has the frequency-related amplitude measuring device 200 and the comparison device 210 in accordance with FIG. 2 as well as the frequency curve measuring device 300 and the comparison device 310 in accordance with FIG. 5. In this regard, reference is made to the above explanations in connection with FIGS. 2 and 5.

The upper branch of the evaluation device 130 in FIG. 8 is formed by the amplitude measuring device 200 and the comparison device 210 in accordance with FIG. 2 and evaluates the response signal AS with regard to the signal levels at the two signal frequencies f1 and f2, as already explained above in connection with FIG. 2. If the signal levels differ beyond a predefined threshold, the comparison device 210 generates a first auxiliary signal H1 on the output side with a logical "1" which is transmitted to a downstream OR gate 400.

The lower branch of the evaluation device 130 in FIG. 8 is formed by the frequency curve measuring device 300 and the comparison device 310 in accordance with FIG. 5. The frequency curve measuring device 300 and the comparison device 310 evaluate the response signal AS with regard to the edge steepness during signal frequency changes, as already explained above in connection with FIG. 5. If the comparison device 310 determines that the edge steepness is insufficiently great during signal frequency changes, it generates a second auxiliary signal H2 with a logical "1" on the output side which is transmitted to the OR gate 400.

The OR gate 400 generates a crosstalk warning UW on the output side in the form of a logical "1" if at least one of the two auxiliary signals H1 or H2 has a logical "1" on the input side.

If neither the first auxiliary signal H1 nor the second auxiliary signal H2 has a logical "1", the OR gate 400 generates an output signal OK in the form of a logical "0", which indicates that there is no crosstalk.

Figure 9:
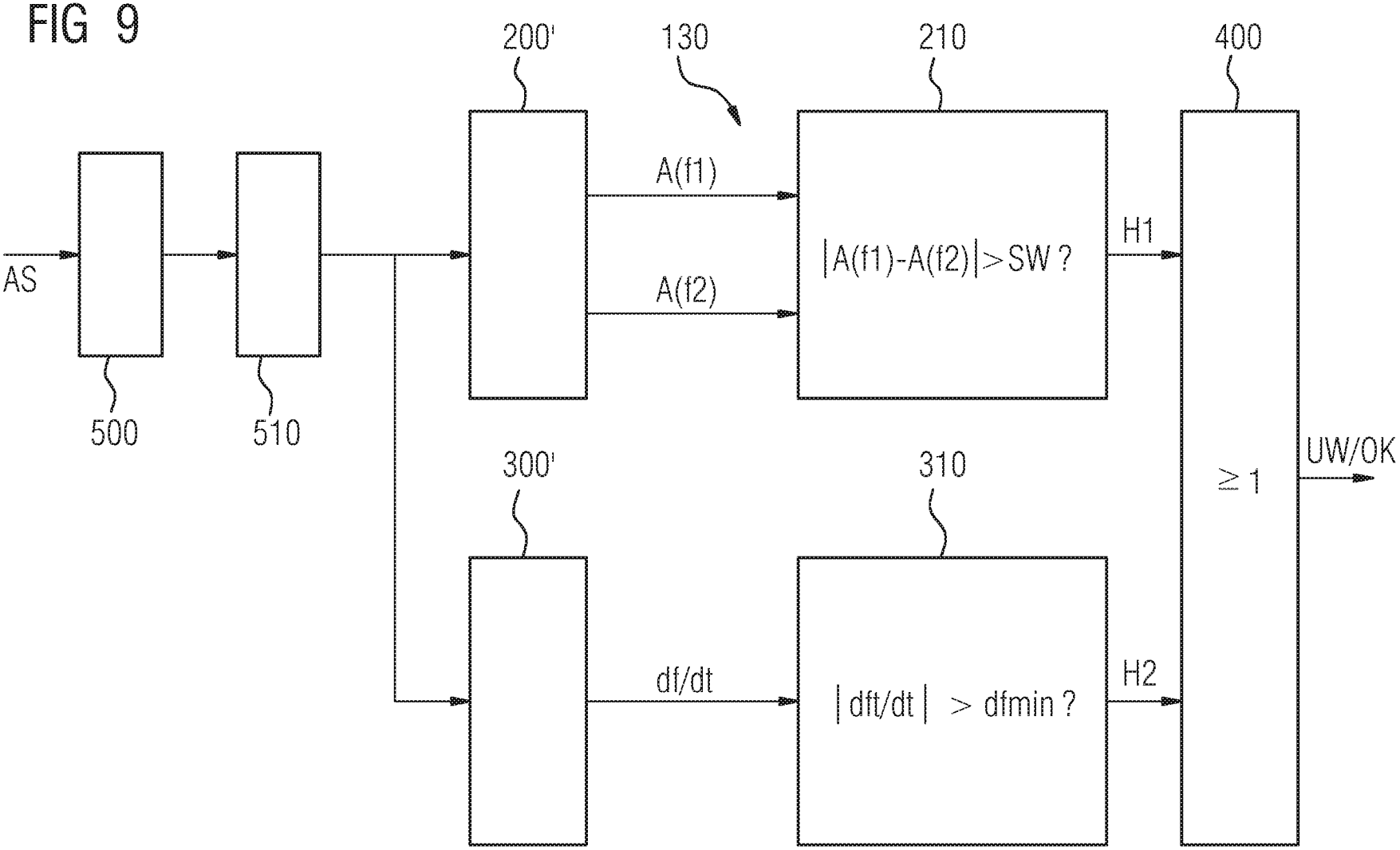
FIG. 9 shows yet another exemplary embodiment of an evaluation device which can be used in the vehicle-based devices of the rail vehicles in accordance with FIG. 1.

FIG. 9 shows a variant of the exemplary embodiment in accordance with FIG. 8 in which a sampling unit 500 and a unit 510 for Fourier transform operate for the upper and lower branch of the evaluation device 130. Accordingly, these units may be omitted in the amplitude measuring device 200' and the frequency curve measuring device 300'.

Although the invention has been illustrated and described in more detail by preferred exemplary embodiments, the invention is not limited by the disclosed examples, and other variations may be derived therefrom by a person skilled in the art without departing from the scope of the invention.

The invention claimed is:

1. A vehicle-based device for a vehicle or a rail vehicle, the device comprising:

a receiving device configured for receiving an at least frequency-modulated signal from a track-based transmission device upon passing the track-based transmission device; and an evaluation device configured for generating a crosstalk warning in dependence on at least one of signal levels at different frequencies of the received frequency-modulated transmission signal or a frequency curve of the received frequency-modulated transmission signal;

said evaluation device configured to generate the crosstalk warning when an edge steepness of the frequency curve falls below a predefined degree over time during signal frequency changes.

2. The vehicle-based device according to claim 1, which further comprises:

a vehicle-based transmission device configured for transmitting an activation signal to activate a transponder device including or forming the track-based transmission device;

the frequency-modulated transmission signal being a response signal from the transponder device.

3. The vehicle-based device according to claim 1, wherein said evaluation device is configured to evaluate at least one of the frequency curve or the signal level at different frequencies of the received frequency-modulated transmission signal and to generate the crosstalk warning when at least one of the frequency curve or the signal levels indicate a response signal from a transponder device having been activated by another vehicle-based transmission device.

4. The vehicle-based device according to claim 1, wherein said evaluation device is configured to compare the signal level at a signal frequency of the frequency-modulated transmission signal with a signal level at another signal frequency of the frequency-modulated transmission signal and to generate the crosstalk warning in the event of a deviation in the signal levels beyond a specified level.

5. The vehicle-based device according to claim 1, wherein the frequency-modulated transmission signal is a binary signal having a first signal frequency at a logical "0" and a second signal frequency at a logical "1".

6. The vehicle-based device according to claim 1, wherein said evaluation device is configured to compare the signal level at a signal frequency with a signal level at another signal frequency and to generate the crosstalk warning when a signal level difference reaches or exceeds a predefined threshold or is outside of a predefined set point differential range.

7. The vehicle-based device according to claim 5, wherein said evaluation device is configured to compare the signal level at the first signal frequency with the signal level at the second signal frequency and to generate the crosstalk warning when a signal level difference reaches or exceeds a predefined threshold or is outside of a predefined set point differential range.

8. A vehicle-based device for a vehicle or a rail vehicle, the device comprising:

a receiving device configured for receiving an at least frequency-modulated signal from a track-based transmission device upon passing the track-based transmission device; and an evaluation device configured for generating a crosstalk warning in dependence on at least one of signal levels at different frequencies of the received frequency-modulated transmission signal or a frequency curve of the received frequency-modulated transmission signal;

said evaluation device configured to measure an edge steepness of the signal frequency during signal frequency changes and to generate the crosstalk warning when an amount of edge steepness reaches or falls below a predefined threshold.

9. The vehicle-based device according to claim 1, wherein the vehicle-based device is suitable for activating balises according to the ETCS standard and for processing response signals from balises according to the ETCS standard.

10. A vehicle or a rail vehicle, comprising a vehicle-based device according to claim 1.

11. A method for transmitting at least one piece of information from a track-based transmission device to a passing vehicle or a rail vehicle, the method comprising the following steps:

using the track-based transmission device to transmit a track-based transmission signal being at least frequency-modulated;

carrying out a vehicle-based evaluation of at least one of a signal level at different frequencies of the received transmission signal or a frequency curve of the received transmission signal and generating or not generating a crosstalk warning depending on at least one of the frequency curve or the signal levels;

providing the frequency-modulated transmission signal as a binary signal having a first signal frequency at a logical "0" and a second signal frequency at a logical "1"; and detecting an edge steepness of the signal frequency during signal frequency changes from the first signal frequency to the second signal frequency and from the second signal frequency to the first signal frequency and generating the crosstalk warning (UW) when the edge steepness falls below a predefined degree.

12. The method according to claim 11, which further comprises:

providing the frequency-modulated transmission signal as a binary signal having a first signal frequency at a logical "0" and a second signal frequency at a logical "1"; and comparing the signal level at the first signal frequency with the signal level at the second signal frequency and generating the crosstalk warning when the signal level difference reaches or exceeds a predefined threshold.

13. The method according to claim 11, which further comprises:

detecting the signal level at the first signal frequency, the signal level at the second signal frequency and an edge steepness of the signal frequency during at least one of signal frequency changes from the first signal frequency to the second signal frequency or from the second signal frequency to the first signal frequency; and generating the crosstalk warning when the signal level at the first signal frequency deviates from the signal level at the second signal frequency beyond a predefined degree or the edge steepness of the signal frequency falls below a predefined degree during signal frequency changes.

14. The method according to claim 11, which further comprises:

providing the track-based transmission device as a track-based transponder device or a component of a track-based transponder device or a track-based balise;

using a vehicle-based transmission device to transmit an activation signal to activate the track-based transponder device; and using the track-based transponder device to transmit a response signal being at least frequency-modulated after receiving the activation signal as the track-based transmission signal.

* * * * *